US007000253B1

(12) United States Patent
Kleinert

(10) Patent No.: US 7,000,253 B1
(45) Date of Patent: Feb. 21, 2006

(54) GLOVE WITH WRIST PROTECTOR

(75) Inventor: James M. Kleinert, Louisville, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 0 days.

(21) Appl. No.: 10/866,444

(22) Filed: Jun. 11, 2004

(51) Int. Cl.
*A41D 13/00* (2006.01)

(52) U.S. Cl. ..... 2/20

(58) Field of Classification Search ..... 2/16, 2/20, 159, 160, 161.1, 161.2, 161.6, 162; 128/878, 879; 602/21
See application file for complete search history.

(56) References Cited

U.S. PATENT DOCUMENTS 482,647 A 9/1892 Obear
4,176,839 A * 12/1979 Pinkus ..... 602/64
4,570,269 A 2/1986 Berlese
5,058,573 A * 10/1991 Hess et al. ..... 602/21
5,345,609 A * 9/1994 Fabry et al. ..... 2/20
5,672,151 A * 9/1997 Calderon-Garciduenas .. 602/21
5,706,521 A 1/1998 Haney
5,778,449 A 7/1998 Oetting et al.
5,790,980 A * 8/1998 Yewer, Jr. ..... 2/20
5,802,614 A * 9/1998 Melone, Jr. ..... 2/161.1
6,253,382 B1 7/2001 Kleinert
6,279,163 B1 8/2001 Hale et al.
6,341,376 B1 1/2002 Smerdon, Jr.
6,389,601 B1 5/2002 Kleinert
6,453,474 B1 9/2002 Kleinert
6,502,244 B1 1/2003 Kleinert
6,701,530 B1 3/2004 Kleinert

* cited by examiner

*Primary Examiner*—Gary L. Welch
(74) *Attorney, Agent, or Firm*—Charles G. Lamb; Middleton Reutlinger

(57) ABSTRACT

A glove with protective padding for a wrist covers a dorsal side of the wrist excluding the radio styloid, the Lister's tubercle, and the distal ulna.

9 Claims, 4 Drawing Sheets

GLOVE WITH WRIST PROTECTOR

BACKGROUND OF THE INVENTION

1. Field of the Invention

This invention relates to a glove with wrist straps anatomically contoured to conform and provide stress relief to the wrist. More particularly, the present invention relates to a glove particularly useful in automobile racing that includes wrist protective padding with relief zones at designated areas of the wrist.

2. Description of Related Art

Glove construction for protection of the human hand is well known. In addition, there are a number of patents which teach gloves claimed to be particularly useful when playing baseball, softball, hockey and the like as well as those worn by motorcycle and bicycle enthusiasts. For example, U.S. Pat. No. 5,345,609 teaches a protective glove which includes shock-absorbing cells disposed at selected portions along the top of the glove. U.S. Pat. No. 5,790,980 teaches a hand glove with a polyurethane foam pad in the palm portion of the glove. Other references teach sport gloves for supporting and stabilizing the wrist and hand. Even, other references teach gloves to protect the bony prominence areas of the hand. One of these is U.S. Pat. No. 6,253,382 which teaches shock-absorbing pads positioned for location above and below the center axis of rotation of the metacarpalphangeal joints of the fingers while the metacarpalphangeal joint of the finger are absent of the shock-absorbing pads.

Moreover, there are a number of gloves which have been suggested for use in bicycle and/or motorcycle racing which include protective pads to reduce scrapes and abrasions when the rider falls from the motorcycle or bicycle. However, in many of these gloves, the pads can make it difficult to flex the glove thereby contributing to discomfort for the wearer as well as interfere with the ability to grasp the handle bars of the motorcycle or bicycle.

Even further, in the sport of automobile racing it is common for the racer to endure wrist fatigue and the like during prolong holding and gripping of the steering wheel. And, there have been gloves proposed for use by race car drivers which are to assist in wrist fatigue. However, in many cases when pads are included in the glove the pads interfere with the flexibility of the glove and thereby increase the discomfort to the wearer as well as interfere with the ability of the wearer to grasp the steering wheel for prolonged periods of time with a grip which is necessary for endurance racing.

SUMMARY OF THE INVENTION

It is an object of the present invention to provide an improved glove for preventing wrist fatigue when used for extended periods of time for the grasp of a handle bar of a motorcycle or bicycle or the steering wheel of an automobile, particularly a race car or other endeavors where there is extended periods of time in use of the wrist.

It is another object of the present invention to provide a glove which includes wrist strap padding with selected areas of relief in the area of at least the distal ulna. Moreover, other areas for relief may include the radial styloid and the Lister's tubercle.

It is a further object of the present invention to provide a sports glove for use in automobile racing.

It is also any object to provide a sports glove which provides orthopedic relief to the bony prominenses of the wrist as well as provide anantomical fit and improved comfort.

More particularly, the present invention provides a glove with protective padding disposed to cover a dorsal side of the wrist excluding the distal ulna and/or the radial styloid and the Lister's tubercle. Preferably, the padding covers the metacarpal of the thumb, the carpometacarpal joint of the index finger, the scaphoid, the lunate and the hamate bones.

In the development of the present invention the padding for the wrist area of the hand may be used in conjunction with other padding systems as described in my other issued patents, such as U.S. Pat. No. 6,453,474 and U.S. Pat. No. 6,253,382 which teach the use of shock-absorbing pads positioned for locations above and below the center axis of rotation of the metacarpalphalangeal joints of the fingers and thumb with the metacarpal joints of the fingers being absent of the shock-absorbing pads.

It is realized that in describing the instant invention as a glove, such term includes sport gloves, and the like, as well as work gloves, and the like.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 2:
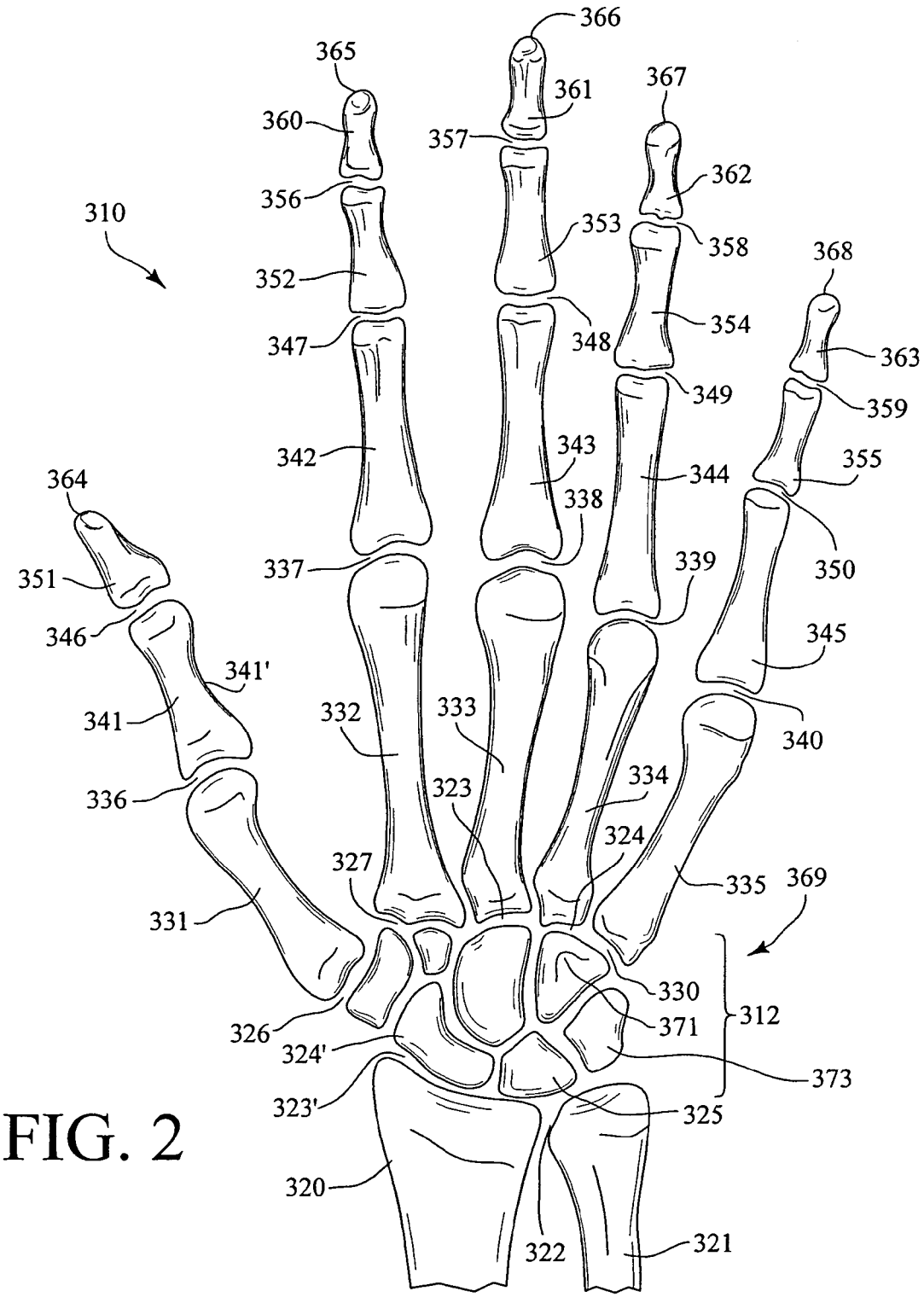
FIG. 2 is a schematic anatomical view of a right human hand showing the dorsal-side detail.

FIG. 2 is a schematic anatomical view of the bones of a right human hand 310 looking at a dorsal side. Shown are the radius 320, ulna 321, radiocarpal joint (RC) 323', distal radio ulnar joint (DRUJ) 322, wrist 312, thumb 364, index finger 365, long finger 366, ring finger 367, and small finger 368. Also shown is a carpus 369 which comprises eight carpal bones, seven of which are shown in FIG. 2. This includes the hamate bone 371 with its hook-like protrusion, the scaphoid 324', the lunate 325 and the triquetrum 373.

The thumb 364 is comprised of the distal phalanx 351, the interphalangeal joint (IP) 346, proximal phalanx 341, diaphysis proximal phalanx 341', metacarpalphalangeal joint (MCP) 336, metacarpal 331, and carpometacarpal joint (CMC) 326.

The index finger 365 is comprised of the distal phalanx 360, distal interphalangeal joint (DIP) 356, middle phalanx 352, proximal interphalangeal joint (PIP) 347, proximal phalanx 342, metacarpalphalangeal joint (MCP) 337, metacarpal 332, and carpometacarpal joint (CMC) 327.

The long finger 366 is comprised of the distal phalanx 361, distal interphalangeal joint (DIP) 357, middle phalanx 353, proximal interphalangeal joint (PIP) 348, proximal phalanx 343, metacarpalphalangeal joint (MCP) 338, metacarpal 333, and carpometacarpal joint (CMC) 323.

The ring finger 367 is comprised of the distal phalanx 362, distal interphalangeal joint (DIP) 358, middle phalanx 354, proximal interphalangeal joint (PIP) 349, proximal phalanx 344, metacarpalphalangeal joint (MCP) 339, metacarpal 334, and carpometacarpal joint (CMC) 324.

The small finger 368 is comprised of the distal phalanx 363, distal interphalangeal joint (DIP) 359, middle phalanx 355, proximal interphalangeal joint (PIP) 350, proximal phalanx 345, metacarpalphalangeal joint (MCP) 340, metacarpal 335, and carpometacarpal joint (CMC) 330.

Figure 1:
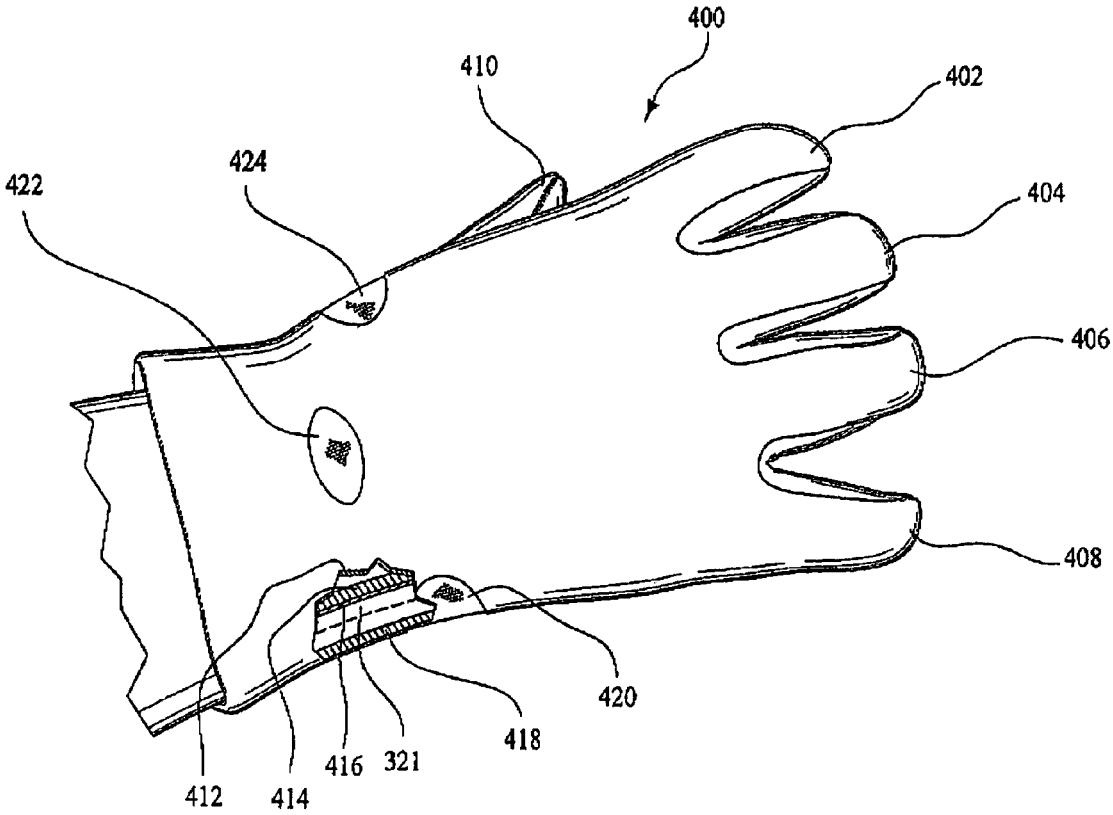
FIG. 1 is a perspective view of a glove of the present invention with selected portions cut-away.

In FIG. 1, a preferred glove 400 is shown, for example, for a right human hand. The glove 400, is particularly useful for race car driving and the like, includes a palmar side panel 418 which covers the palmar side of the hand and a dorsal side glove panel 412 which covers the dorsal or back side of the hand. The glove panels 418 and 412, usually leather, and/or a synthetic equivalent are secured along their outer periphery. The glove 400 commonly includes a thumb section 410, an index finger 402, a long finger section 404, a ring finger section 406, and a small finger section 408. As shown in the cut-away in FIG. 1, an inner cover 416 is provided and in conjunction with the dorsal side glove panel 412 captures the padding 414 therein. Also provided in the glove are relief panels 424 which are positioned over the radial styloid 464, a relief panel 422 which is positioned over the Lister's tubercle 462 and a relief panel 420 which is positioned over the distal ulna 421. The relief panels are usually a flexible soft fabric which yields with the slightest movement of the glove or the hand therein.

Figure 3:
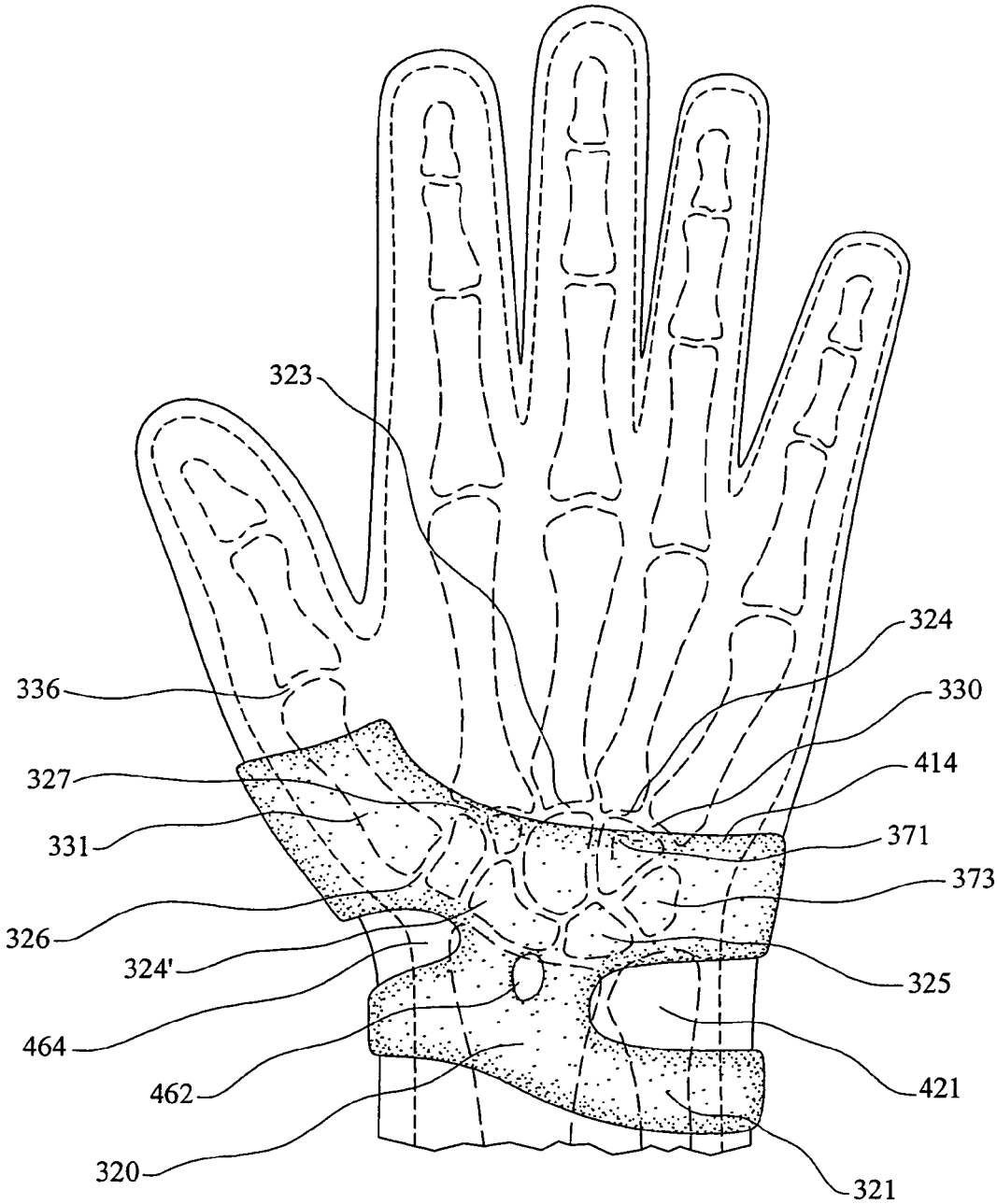
FIG. 3 is a dorsal-side view of a preferred embodiment of the glove of FIG. 1 showing the dorsal-side details overlaying the skeletal structure of a right-dorsal-side human hand inserted in the glove as well as the location for the wrist protective pad; and, FIG. 4 is a dorsal-side view of another embodiment showing the dorsal-side details overlaying the skeletal structure of a right dorsal-side human hand inserted in a glove as well as the location for the wrist protective pad.

As best shown in FIG. 3, the wrist protective pad 414 of the present invention is adapted to cover a portion of the metacarpal 331 of the thumb 364 and extends over the hamate bone 371 with its hook-like protrusion, the triquetrum 373, the scaphoid 324' and the lunate 325. Padding 414 is usually adjacent the carpometacarpal joints 327, 323, 324 and 330 of the fingers 365, 366, 367, and 368, respectively. The padding also extends over radius 320 excluding the area around the radial styloid 464 and the Lister's tubercle 462 and ulna 321 excluding the distal ulna 421. The padding is usually made of a polyurethane foam or the like and is generally from 1/16 to 1/4 inches in thickness. The padding provides relief at the wrist with unloading of the wrist bony prominences, specifically the distal ulna 421, the radial styloid 464, and the Lister's tubercle 462. All three areas may be provided with relief or even just one or two areas in various combinations depending upon the desired application.

Figure 4:
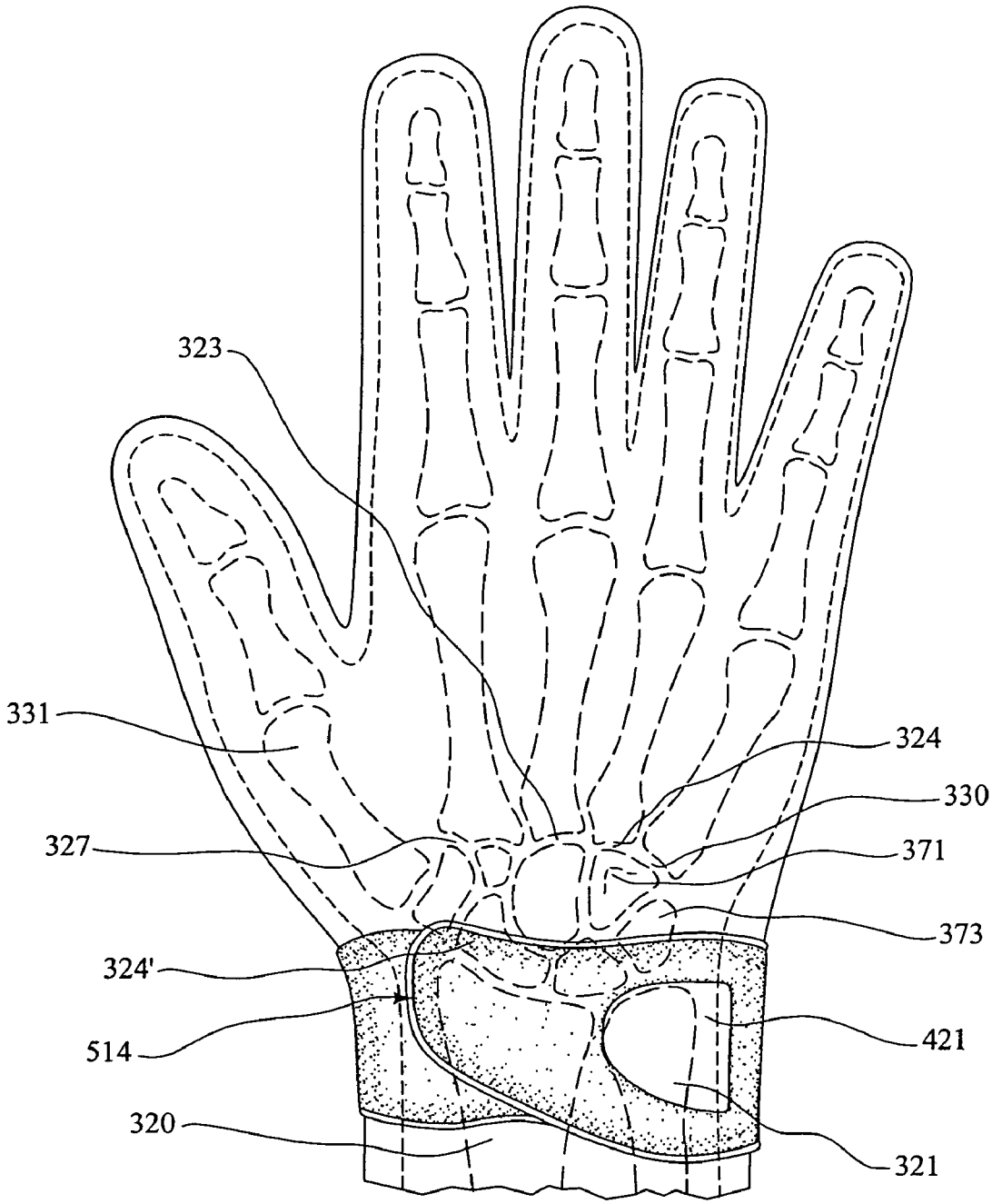

Shown in FIG. 4 is another embodiment of the present invention. In this embodiment a wrist protective pad 514 is adapted to cover the lunate 325, and a portion of the triquetrum 373 and the scaphoid 324'. Padding 514 also covers a portion of the radius 320 and the ulna 321 excluding the distal ulna 421.

The detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A glove with protective padding for a wrist comprising:

a covering sized to cover the palm side, dorsal side, thumb and fingers of a human hand;

a wrist protective padding within said covering disposed to cover a dorsal-side of a wrist excluding the radio styloid, the Lister's tubercle, and the distal ulna.

2. The glove of claim 1, said wrist protective padding covering the thumb metacarpal terminating below the metacarpalphalangeal joint.

3. The glove of claim 1, said wrist protective padding covering the wrist areas adjacent the carpometacarpal joints of the index finger, the long finger, the ring finger and the small finger.

4. The glove of claim 1 wherein said wrist protective padding covers the thumb metacarpal terminating below the metacarpalphalangeal joint and the wrist areas adjacent the carpometacarpal joints of the index finger, the long finger, the ring finger and the small finger.

5. In combination with a glove for receiving a human hand therein, the improvement comprising:

a wrist protective padding disposed to cover a dorsal-side of the wrist excluding the radio styloid, the Lister's tubercle, and the distal ulna.

6. The combination of claim 5 wherein said wrist protective padding covers the thumb metacarpal terminating below the metacarpalphalangeal joint.

7. The combination of claim 5 wherein said wrist protective padding covers the wrist areas adjacent the carpometacarpal joints of the index finger, the long finger, the ring finger, and the small finger.

8. The combination of claim 5 wherein said wrist protective padding covers the thumb metacarpal terminating below the metacarpalphalangeal joints the wrist areas adjacent the carpometacarpal joints of the index finger, the long finger, the ring finger, and the small finger.

9. A glove with protective padding for a wrist comprising:

a covering sized to cover the palm side, dorsal side, thumb and fingers of a human hand; and, a wrist protective padding within said covering disposed to cover a dorsal-side of a wrist excluding the distal ulna, said wrist protective padding covering a portion of the lunate, scaphoid, and triquetrum areas of the wrist excluding the hamate.

* * * * *